US008879361B2

(12) United States Patent
McGee

(10) Patent No.: US 8,879,361 B2
(45) Date of Patent: Nov. 4, 2014

(54) BOAT TRANSDUCER MOUNTING APPARATUS

(76) Inventor: Troy A. McGee, Coker, AL (US)

( * ) Notice: Subject to any disclaimer, the term of this patent is extended or adjusted under 35 U.S.C. 154(b) by 133 days.

(21) Appl. No.: 13/405,338

(22) Filed: Feb. 26, 2012

(65) Prior Publication Data

US 2013/0221175 A1 Aug. 29, 2013

(51) Int. Cl.
*H04R 1/00* (2006.01)

(52) U.S. Cl.
USPC ..... 367/173; 248/229.1

(58) Field of Classification Search
USPC ..... 248/229.14, 229.24, 231.61, 229.1, 248/229.11, 229.2, 229.21, 226.11, 231.31, 248/287.1, 316.2, 316.6; 367/173
See application file for complete search history.

(56) References Cited

U.S. PATENT DOCUMENTS

| | | | | |
|---|---|---|---|---|
| 3,989,213 | A | 11/1976 | Allen | |
| 5,016,225 | A | 5/1991 | Blomberg | |
| 5,573,221 | A | 11/1996 | Reeves | |
| 6,286,797 | B1 * | 9/2001 | Thaxton | 248/229.14 |
| 6,644,614 | B1 * | 11/2003 | Chen | 248/316.1 |
| 6,904,720 | B1 * | 6/2005 | Adolfson et al. | 52/63 |
| 6,913,234 | B2 * | 7/2005 | Weiss | 248/231.71 |
| 7,548,490 | B2 | 6/2009 | Snyder | |
| 7,677,514 | B1 | 3/2010 | Palmer | |
| 8,347,476 | B2 * | 1/2013 | Chu | 29/282 |
| 8,534,650 | B2 * | 9/2013 | Humfeldt et al. | 269/37 |
| 2004/0135047 | A1 * | 7/2004 | Hunt | 248/229.14 |

* cited by examiner

*Primary Examiner* — Steven Marsh

(57) ABSTRACT

An apparatus for mounting a transducer on a boat includes a pair of slotted portions adjustably connected to one another. One of the slotted portions includes a transducer mounting portion, which can be used to mount a transducer to the apparatus. The apparatus can be mounted to a boat by positioning the apparatus close to the boat and then adjusting the slotted portions so that slots included in these portions engage with the boat and hold the apparatus in place.

14 Claims, 7 Drawing Sheets

BOAT TRANSDUCER MOUNTING APPARATUS

BACKGROUND OF THE INVENTION

The present invention relates generally to apparatuses that can be used to mount a transducer on a boat. More specifically, the present invention pertains to an apparatus that can be used to mount a transducer on a boat without damaging the boat.

Transducers for boats are well known in the art. These devices are usually mounted to boats using bolts that damage the boat by leaving bolt holes when the transducer is removed. The damaged portions of the boat can be unsightly and diminish the value of the boat if it is ever sold by its current owner. As a result, there is a need for a way to mount a transducer to a boat that does not cause damage to the boat.

SUMMARY OF THE INVENTION

The present invention is directed toward an apparatus that can be used to mount a transducer to a boat without causing damage to the boat. In one embodiment, the apparatus includes a pair of slotted portions adjustably connected to one another. One of the slotted portions includes a transducer mounting portion, which can be used to mount a transducer to the apparatus. The apparatus can be mounted to a boat by positioning the apparatus close to the boat and then adjusting the slotted portions so that slots included in these portions engage with the boat and hold the apparatus in place. In one embodiment, the apparatus is designed so that it can be positioned close to the transom of a boat and then adjusted so that the slots engage with and clamp down on the transom.

DETAILED DESCRIPTION OF THE INVENTION

Figure 1:
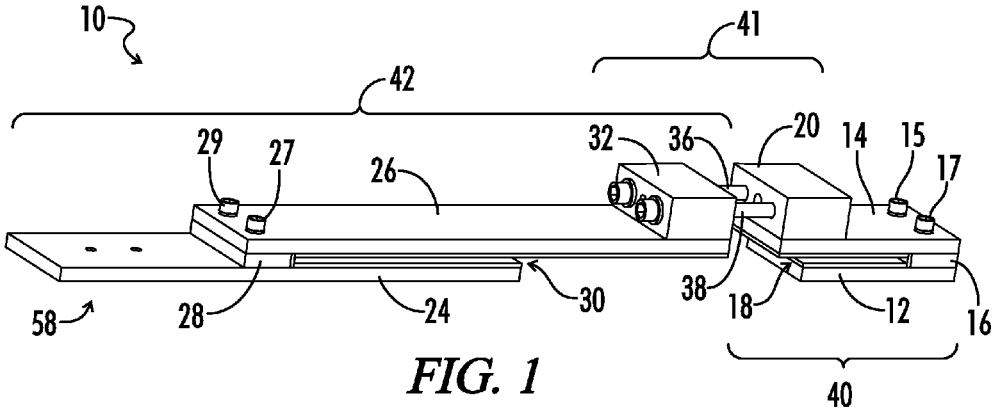
FIG. 1 is a side view of one embodiment of the present invention.
Figure 2:
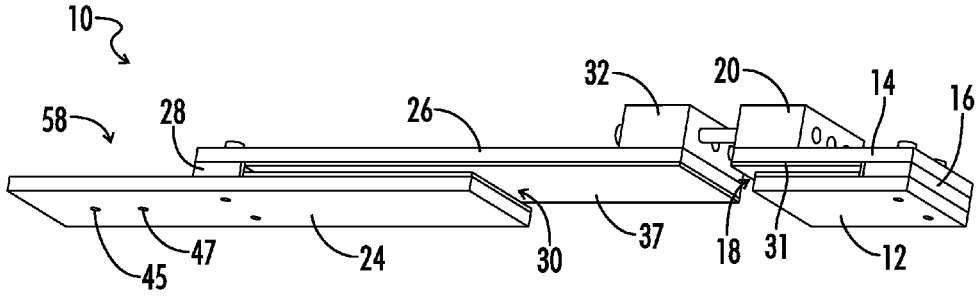
FIG. 2 is a back view of the embodiment shown in FIG. 1.
Figure 3:
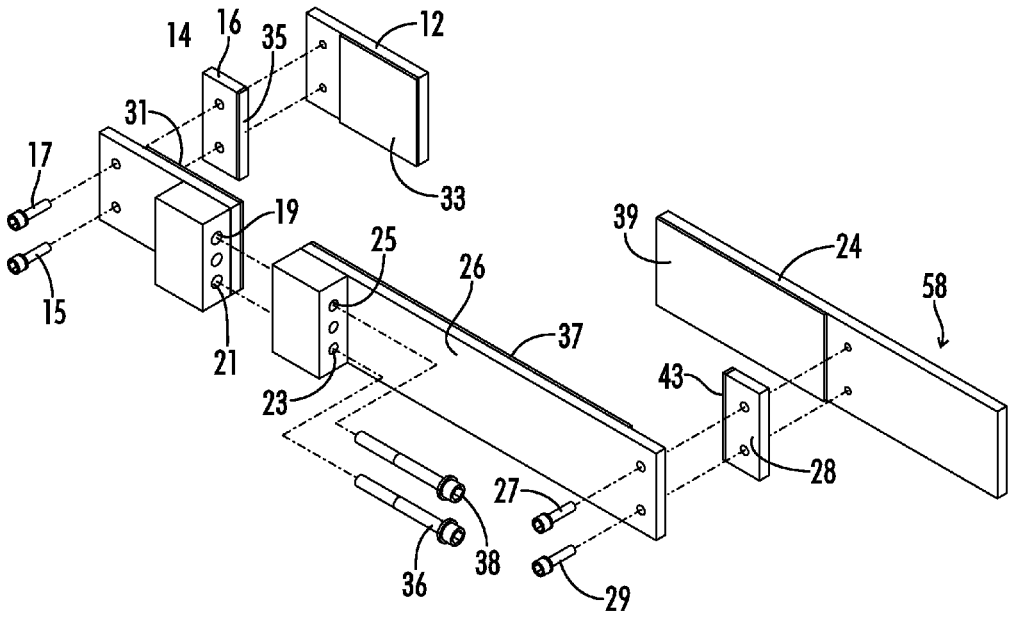
FIG. 3 is an exploded view of the embodiment shown in FIG. 1.
Figure 4:
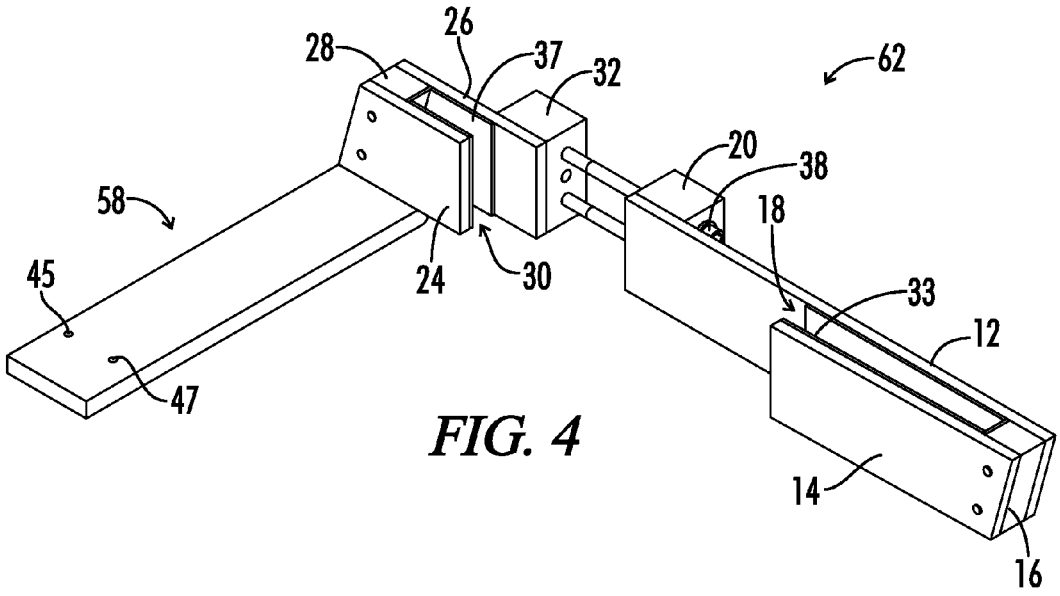
FIG. 4 is a front view of a second embodiment of the present invention.
Figure 5:
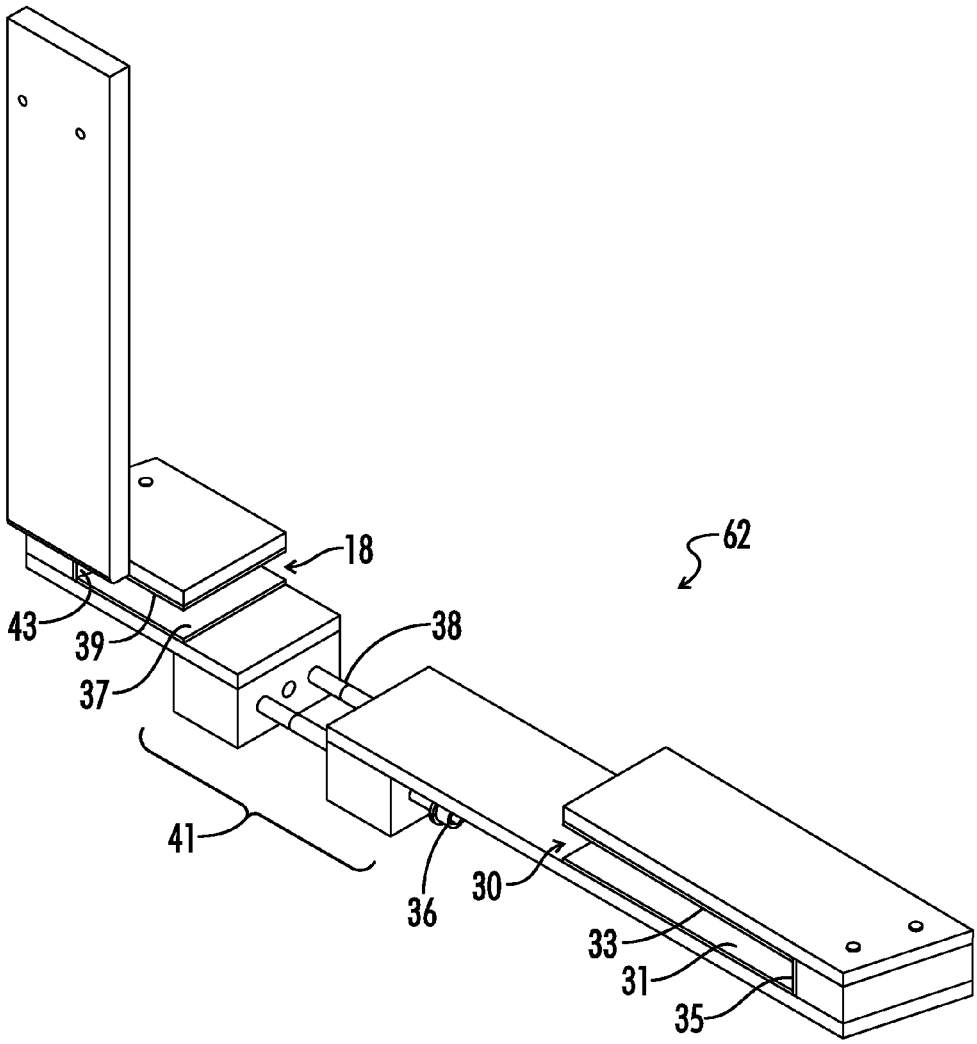
FIG. 5 is a side view of the second embodiment shown in FIG. 4.
Figure 6:
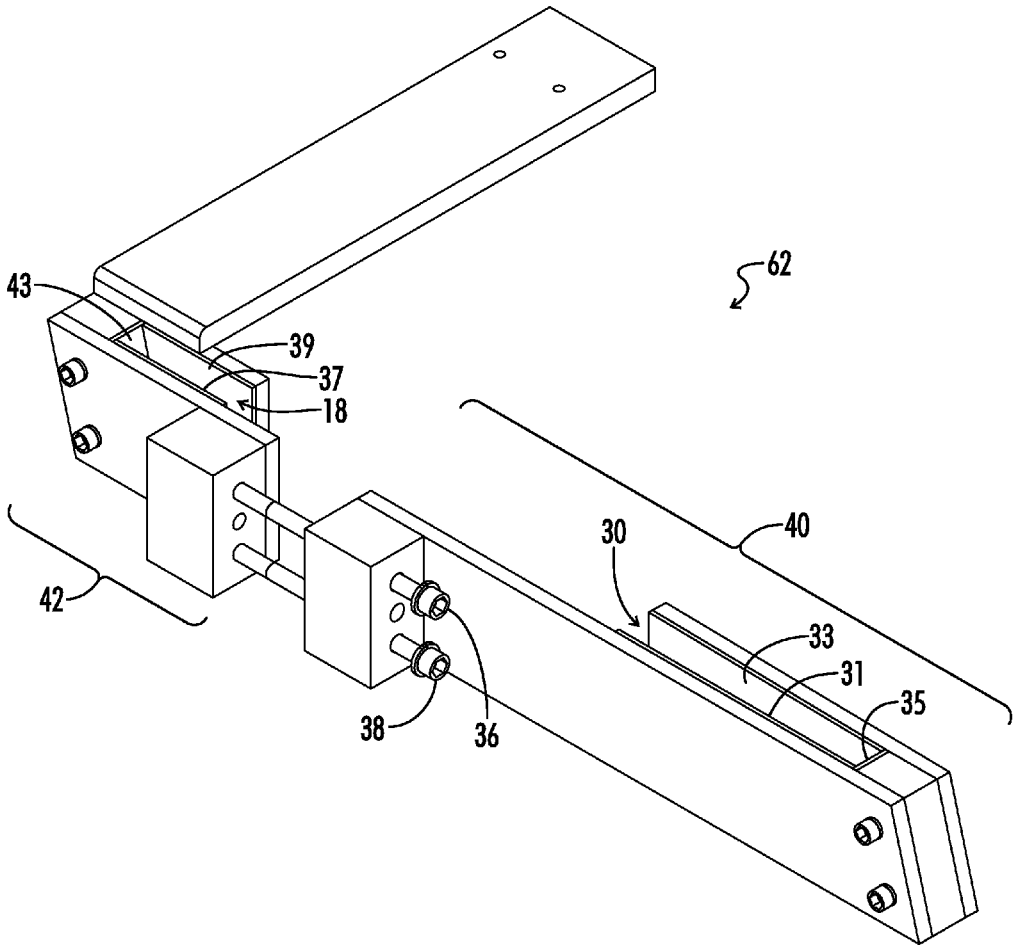
FIG. 6 is a back view of the second embodiment shown in FIG. 4.
Figure 7:
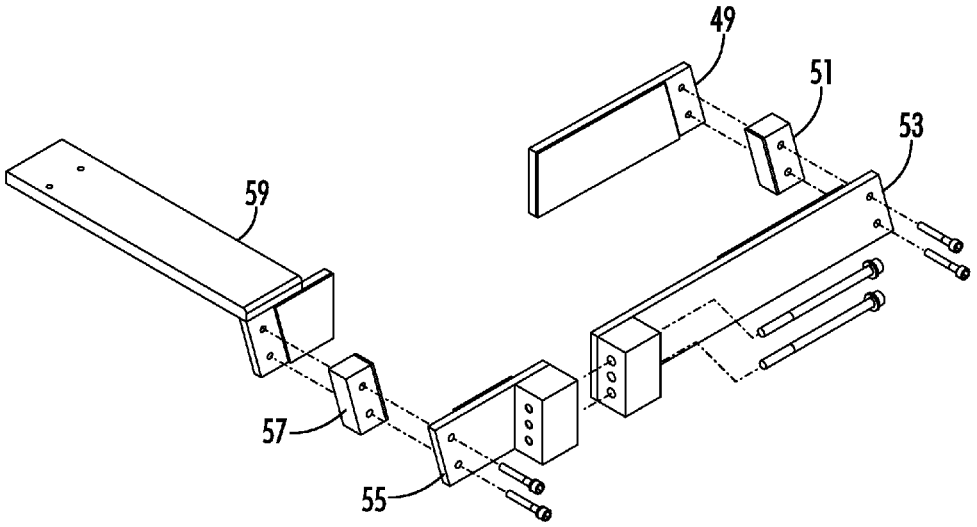
FIG. 7 is an exploded view of the embodiment shown in FIG. 4.
Figure 8:
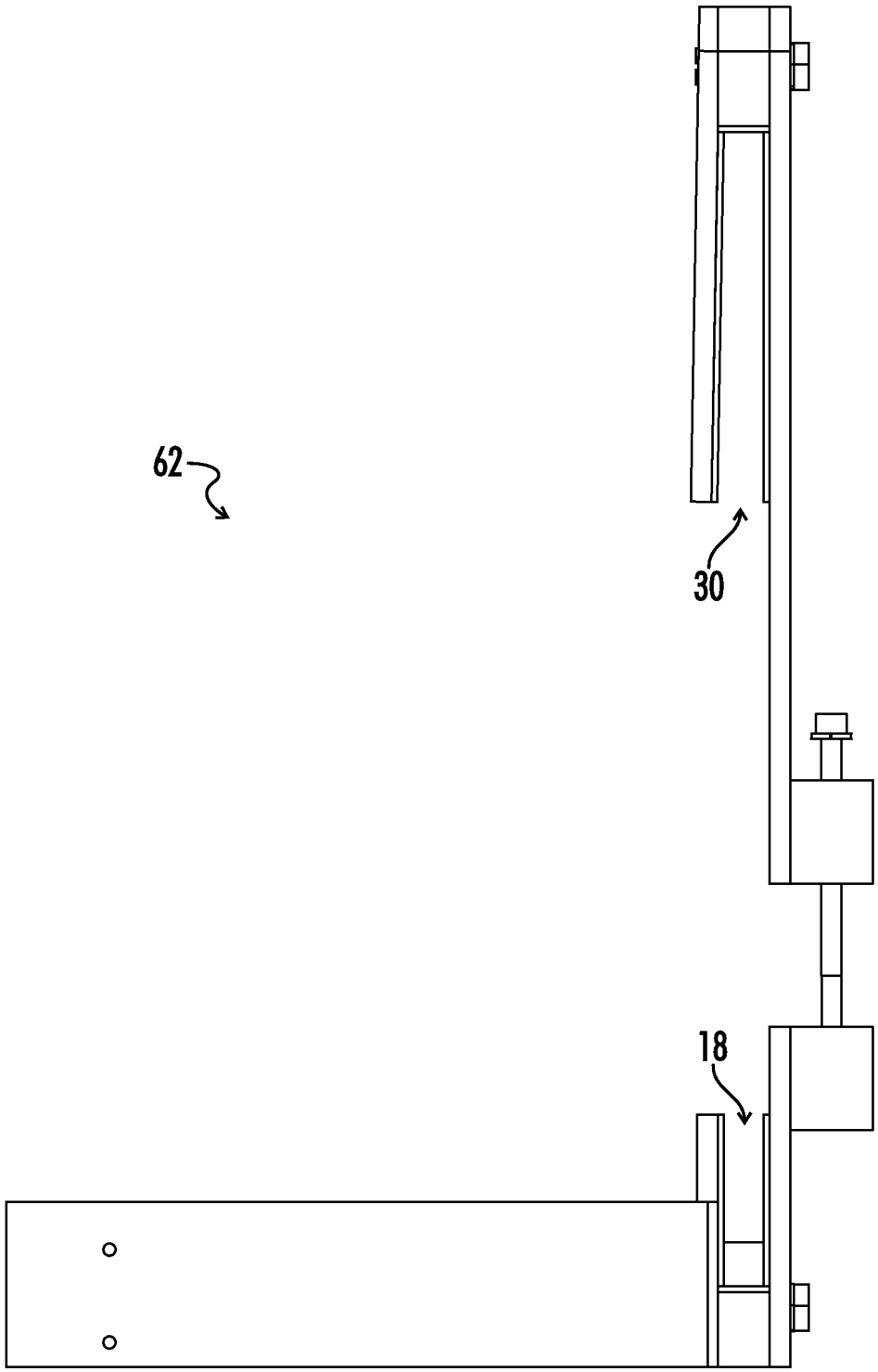
FIG. 8 is a second side view of the second embodiment shown in FIG. 4.

Referring to FIGS. 1-3, one embodiment of the present invention, apparatus 10, includes a first plate (or first leg) 12 connected to a second plate (or second leg) 14 using a first spacer 16 to form a first slot 18, a threaded block 20 located on one end of the second plate 14, a third plate (or third leg) 24 connected to a fourth plate (or fourth leg) 26 using a second spacer 28 to form a second slot 30, and a mounting block 32 located on one end of the fourth plate 26 and adjustably connected to the threaded block 20 using a pair of bolts, 36 and 38.

The first plate 12, second plate 14, and first spacer 16 may be manufactured out of steel and connected together using a pair of bolts, 15 and 17. These components may also be integrated into a single piece, referred to as a first slotted portion 40, rather than connected together using bolts. The first slotted portion 40 may or may not include the threaded block 20.

The third plate 24, fourth plate 26, and second spacer 28 may be manufactured out of steel and connected together using a pair of bolts, 27 and 29. These components may also be integrated into a single piece, referred to as a second slotted portion 42, rather than connected together using bolts. The second slotted portion 42 may or may not include the mounting block 32.

The threaded block 20, mounting block 32, and bolts 36 and 38 form an adjustable connecting means 41 adjustably connecting together the first and second slotted portions, 40 and 42, so that the first and second slotted portions, 40 and 42, can be moved inward and outward with respect to one another. Turning bolts 36 and 38 in one direction causes first and second slotted portions, 40 and 42, to move inward toward one another. Turning bolts 36 and 38 in the opposite direction causes the opposite effect, e.g., the first and second slotted portions, 40 and 42, move outward away from one another.

The first plate 12 may include one end aligned with one end of the first spacer and one end of the second plate 14. The first plate 12 may extend outward from the first spacer 16 and be aligned with, parallel to, and overlap with the second plate 14. The first plate 12, first spacer 16, and second plate 14 may have the same width and the second plate 14 may be longer than the first plate 12.

The threaded block 20 may extend perpendicularly outward from one side of the second plate 14. The threaded block 20 and the first spacer 16 may be located on opposite sides and opposite ends of the second plate 14. The threaded block 20 and the second plate 14 may have the same width and the threaded block 20 may include a set of threads, 19 and 21 (see FIG. 3) defined therein.

The fourth plate 26 may include one end aligned with one end of the second spacer 28. The fourth plate 26 may extend outward from the second spacer 28 toward the first slot 18 and may be aligned with, parallel to, and overlap with the third plate 24. The third plate 24, second spacer 28, and fourth plate 26 may have the same width.

The mounting block 32 may extend perpendicularly outward from one side of the fourth plate 26. The mounting block 32 and the second spacer 28 may be located on opposite sides and opposite ends of the fourth plate 26. The mounting block 32 and fourth plate 26 may have the same width and the mounting block 32 may include a set of unthreaded bolt openings, 23 and 25, (see FIG. 3) defined therein.

Apparatus 10 may include thin rubber padded portions, 31, 33, and 35 lining the inner portions of slot 18 and thin rubber padded portions, 37, 39, and 43 lining the inner portions of slot 30. As shown in FIG. 2, thin rubber portion 37 may extend out from slot 30 along the length of fourth plate 26 and thin rubber portion 31 may extend out from slot 18 along the length of second plate 14.

The third plate 24 may include a transducer mounting portion 58 extending outward from the second spacer 28 away from the first slot 18. Alternatively, as shown in FIGS. 4-7, the transducer mounting portion 58 may be located on one end of a fifth plate 60 extending perpendicularly outward from the third plate 24. The fifth plate 60 may be longer than the third plate 24. In either case, the transducer mounting portion 58 may include a pair of threaded openings, 45 and 47, for using in securing a transducer (not shown) to the transducer mounting portion 58 with a pair of bolts.

The second embodiment of the present invention, apparatus 62, shown in FIGS. 4-7 is very similar to the first embodiment of the invention, apparatus 10, shown in FIGS. 1-3. The main differences relate to the lengths of the first and second plates/legs, 12 and 14, which are longer in the second embodiment, the lengths of the third and fourth plates/legs, 24 and 26, which are shorter in the second embodiment, and the location of the transducer mounting portion 58, which is located on the fifth plate 60 in the second embodiment rather than being included as part of the third plate 24 in the first embodiment. In the second embodiment, the aligned ends, 49, 51, and 53 (see FIG. 7), of first plate 12, second plate 14, and spacer 16 are slanted with respect to the opposite ends of these pieces and the aligned ends, 55, 57, and 59, of third plate 24, fourth plate 26, and spacer 28 are slanted in a similar manner.

As shown in FIGS. 1 and 2, the first and second slots, 18 and 30, may be located in a single plane with the first slot 18 extending outward from the first spacer 16 toward the second slot 30 and the second slot 30 extending outward from the second spacer 28 toward the first slot 18. Slots 18 and 30 may be sized so that they can fit over and engage with a transom typically included on a boat. Slots 18 and 30 may also be sized to fit over and engage other parts of a boat in other embodiments.

The first, second, third, fourth, and fifth plates, 12, 14, 24, 26, and 60 may be elongated, flat and rectangular, and the first and second spacers, 16 and 28, may be flat and rectangular. Spacers 16 and 28 may also be flat slanted rectangles as shown FIG. 7.

In use, the first embodiment, apparatus 10, may be connected to a boat (not shown) by positioning the embodiment 10 so that first and second slots, 18 and 30, overlap the transom of a boat and then turning bolts, 36 and 38, so that slots 18 and 30 engage with and clamp down on the transom. A transducer (not shown) is then mounted to the transducer mounting portion 58 using bolts or some other appropriate means. Alternatively, the transducer may be secured to the transducer mounting portion 58 and then the apparatus 10 may be secured to the boat transom. This embodiment may be removed by simply turning the bolts, 36 and 38, in the opposite direction until the slots, 18 and 30, disengage from the boat transom.

The above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

What is claimed is:

1. An apparatus for mounting a transducer on a boat without damaging the boat, comprising:

a first plate connected to a second plate using a first spacer to form first slot;

a threaded block located on one end of the second plate;

a third plate connected to a fourth plate using a second spacer to form a second slot; and a mounting block located on one end of the fourth plate and adjustably connected to the threaded block using a pair of bolts;

wherein the first plate includes one end aligned with one end of the first spacer and one end of the second plate; the first plate extends outward from the first spacer and is aligned with, parallel to, and overlaps with the second plate; the first plate, first spacer, and second plate have the same width; and the second plate is longer than the first plate.

2. The apparatus of claim 1, wherein the threaded block extends perpendicularly outward from one side of the second plate; the threaded block and the first spacer are located on opposite sides and opposite ends of the second plate; the threaded block and second plate have the same width; and the threaded block includes a set of threads defined therein.

3. The apparatus of claim 2, wherein the fourth plate includes one end aligned with one end of the second spacer; the fourth plate extends outward from the second spacer toward the first slot and is aligned with, parallel to, and overlaps with the third plate; and the third plate, second spacer, and fourth plate have the same width.

4. The apparatus of claim 3, wherein the mounting block extends perpendicularly outward from one side of the fourth plate; the mounting block and the second spacer are located on opposite sides and opposite ends of the fourth plate; the mounting block and fourth plate have the same width; and the mounting block includes a set of unthreaded bolt openings defined therein.

5. A boat transducer mounting apparatus, comprising:

a first slotted portion having a first slot;

a second slotted portion having a second slot and a transducer mounting portion extending therefrom; and an adjustable connecting means for adjustably connecting the first and second portions so that the first and second slotted portions can be moved inward and outward with respect to one another;

wherein the first and second slots are located in a single plane with the first slot extending outward from the first spacer toward the second slot and the second slot extending outward from the second spacer toward the first slot.

6. The apparatus of claim 5, wherein the first slotted portion includes a first plate connected to a second plate using a first spacer to form the first slot, the first plate having one end aligned with one end of the first spacer and one end of the second plate.

7. The apparatus of claim 5, wherein the first slotted portion includes a first plate extending outward from a first spacer and aligned with, parallel to, and overlapping with a second plate to form the first slot, the first plate, first spacer, and second plate having the same width, the second plate being longer than the first plate.

8. The apparatus of claim 5, wherein the second slotted portion includes a third plate connected to a fourth plate using a second spacer to form the second slot, the fourth plate having one end aligned with one end of the second spacer.

9. The apparatus of claim 5, wherein the second slotted portion includes a third plate connected to a fourth plate using a second spacer, the fourth plate extending outward from the second spacer toward the first slot and aligned with, parallel to, and overlapping with the third plate to form the second slot, the third plate, second spacer, and fourth plate having the same width.

10. The apparatus of claim 5, wherein the adjustably connecting means includes:

a threaded block located on one end of the second plate, the threaded block extending perpendicularly outward from one side of the second plate, the threaded block and the first spacer located on opposite sides and opposite ends of the second plate, the threaded block and second plate having the same width, the threaded block including a set of threads defined therein; and a mounting block adjustably connected to the threaded block using a pair of bolts, the mounting block located on one end of the fourth plate, the mounting block extending perpendicularly outward from one side of the fourth plate, the mounting block and the second spacer located on opposite sides and opposite ends of the fourth plate, the mounting block and fourth plate having the same width, the mounting block including a set of unthreaded bolt openings defined therein.

11. A transducer mounting apparatus for a boat, comprising:

a first slotted portion having a first slot;

a threaded block located on one end of the first slotted portion, the first slot and the threaded block located on opposite ends of the first slotted portion;

a second slotted portion having a second slot and a transducer mounting portion extending therefrom; and a mounting block located on one end of the second slotted portion and adjustably connected to the threaded block using a pair of bolts, the second slot and the mounting block located on opposite ends of the second slotted portion;

wherein:

the first slotted portion includes a first leg extending outward from the first slotted portion and parallel to and overlapping with a second leg extending outward from the first slotted portion; the first leg and second leg having the same width; the second leg being longer than the first leg; and the second slotted portion includes a third leg extending outward from the second slotted portion and parallel to and overlapping with a fourth leg extending outward from the second slotted portion; the third leg and fourth leg having the same width, the fourth leg being longer than the third leg.

12. The apparatus of claim 11, wherein:

the threaded block extends perpendicularly outward from one side of the second leg; the threaded block and the first slot are located on opposite sides of the second leg; the threaded block and second leg have the same width; and the threaded block includes a set of threads defined therein; and the mounting block extends perpendicularly outward from one side of the fourth leg; the mounting block and the second slot are located on opposite sides of the fourth leg; the mounting block and fourth leg have the same width; the mounting block includes a set of unthreaded bolt openings defined therein.

13. The apparatus of claim 11, wherein the transducer mounting portion extends outward from the third leg away from the first and second slots in a plane parallel to the second slot or the transducer mounting portion extends perpendicularly outward from the third leg away from the second slot in a plane perpendicular to the second slot.

14. The apparatus of claim 13, wherein the first and second slots are located in a single plane with the first slot extending outward from the first slotted portion toward the second slot and the second slot extending outward from the second slotted portion toward the first slot.

* * * * *